United States Patent [19]

Young

[11] 4,307,404

[45] Dec. 22, 1981

[54] DICHROIC SCANNER FOR CONSCAN ANTENNA FEED SYSTEMS

[75] Inventor: Lock R. Young, Palm Bay, Fla.

[73] Assignee: Harris Corporation, Melbourne, Fla.

[21] Appl. No.: 122,047

[22] Filed: Feb. 19, 1980

Related U.S. Application Data

[63] Continuation of Ser. No. 887,967, Mar. 20, 1978.

[51] Int. Cl.[3] ..... H01Q 19/06

[52] U.S. Cl. ..... 343/754; 343/909

[58] Field of Search ..... 343/901, 753, 754, 755, 343/909, 911 R; 350/164–166

[56] References Cited

U.S. PATENT DOCUMENTS

| | | | |
|---|---|---|---|
| 2,577,619 | 12/1951 | Kock | 343/753 |
| 2,703,842 | 3/1955 | Lewis | 343/840 |
| 3,255,451 | 6/1966 | Wolcott | 343/754 |
| 3,389,394 | 6/1968 | Lewis | 343/753 |
| 3,633,206 | 1/1972 | McMillan | 343/754 |

*Primary Examiner*—David K. Moore

*Attorney, Agent, or Firm*—Craig and Antonelli

[57] ABSTRACT

A dichroic antenna scanner is comprised of transmission or reflection surfaces that impart to an incoming wave a phase shift which varies across the surface of the antenna. For this purpose, a multilayer dichroic structure may be configured to have a controlled tapered spacing between the various layers or a variable reflectance across the dichroic surface, thereby varying the cut-off frequency of the dichroic surface across its surface. Since the phase of a transmitted or reflected wave varies rapidly in the vicinity of the cut-off frequency, a variation in the cut-off frequency across the dichroic surface yields a varying phase characteristic across the antenna. Because the phase shift characteristic of the dichroic is frequency-dependent and varies sharply in the vicinity of the cut-off frequency, an incoming wave, the frequency of which is far from cut-off, will not be as greatly affected as one near cut-off, so that selection of effectively scanned and nonscanned frequencies is possible merely by adjusting the insertion loss characteristic of the multilayer dichroic structure. Selective scanning of different frequencies may be accomplished by rotating the dichroic surface structure.

29 Claims, 9 Drawing Figures

TYPICAL ANTENNA RESPONSE FOR THREE CAPACITIVE LAYERS

DICHROIC SCANNER FOR CONSCAN ANTENNA FEED SYSTEMS

This is a request for filing a Continuation application under 37 CFR 1.60, of pending prior application Ser. No. 887,967, filed Mar. 20, 1978 of Lock R. YOUNG for DICHROIC SCANNER FOR CONSCAN ANTENNA FEED SYSTEMS.

FIELD OF THE INVENTION

The present invention relates to antenna systems and is particularly directed to an antenna configuration, the phase shift through which is variable across the surface of the antenna so as to provide a tiltable phase front for a transmitted or reflected wave of interest and thereby permit the selective scanning of different frequencies.

BACKGROUND OF THE INVENTION

An often desired objective and, in some instances, a requirement of a transmitting and/or receiving antenna system, is the ability of the system to scan one frequency without affecting another frequency that the system may be transmitting or receiving. A conventional approach to meet this objective has involved the use of often complicated, special purpose, mechanically displaced antenna feed or dielectric lens arrangements, through which control of the desired scanning operation is exclusively conducted. Unfortunately, such systems may be both complex and costly, and their operations may differ depending upon the type of system involved. For example, for a dual apex/cassegrain system, conventional practice has been to separately scan each feed; on the other hand, a dichroic scanner operates for each feed simultaneously.

SUMMARY OF THE INVENTION

In accordance with the present invention, an improved dichroic antenna system, which does not suffer from the complexity and separate operational requirements of the prior art, is comprised of multilayer, frequency selective, transmission or reflection surfaces that impart to an incoming wave a phase shift which varies across the surface of the antenna. For this purpose, the multilayer dichroic structure may be configured to have a controlled tapered spacing between the various layers or a variable reflectance across the surface of the dichroic structure, thereby varying the cut-off frequency dichroic structure across its surface. Since the phase of a transmitted or reflected wave varies rapidly in the vicinity of the cut-off frequency, a variation in the cut-off frequency across the dichroic surface yields a varying phase characteristic across the antenna. In other words, a non-uniform phase shift pattern can be created for waves having a frequency near cut-off, thereby effectively tilting the phase fronts of such waves and permitting selective scanning of different frequencies simply by rotating the multilayered dichroic surface about an appropriate axis, such as the antenna feed horn axis. Because the phase shift characteristic of the dichroic structure is frequency dependent and varies sharply in the vicinity of the cut-off frequency, an incoming wave, the frequency of which is far from cut-off, will not be as greatly affected as one near cut-off, so that selection of effectively scanned and non-scanned frequencies is possible merely by adjusting the insertion loss characteristic of the multilayer dichroic structure. This frequency sensitivity of phase tilt achieved in accordance with the present invention makes it possible to greatly simplify the physical structure and size of the scanning elements of the antenna, as contrasted with prior art systems.

DETAILED DESCRIPTION

In order to facilitate an understanding of the present invention, geometrical relationships which may serve to illustrate frequency-dependent characteristics of multilayer dichroic antenna structures will be diagrammatically explained for a pair of dichroic structures or models of respectively different shapes. One of these models is a spherically shaped multilayer structure, while the other is essentially of planar configuration. Such structural shapes or models are not to be considered limitative of antenna configurations to which the present invention is applicable, but are described herein to illustrate exemplary geometries to which the invention may be adapted.

Figure 1:
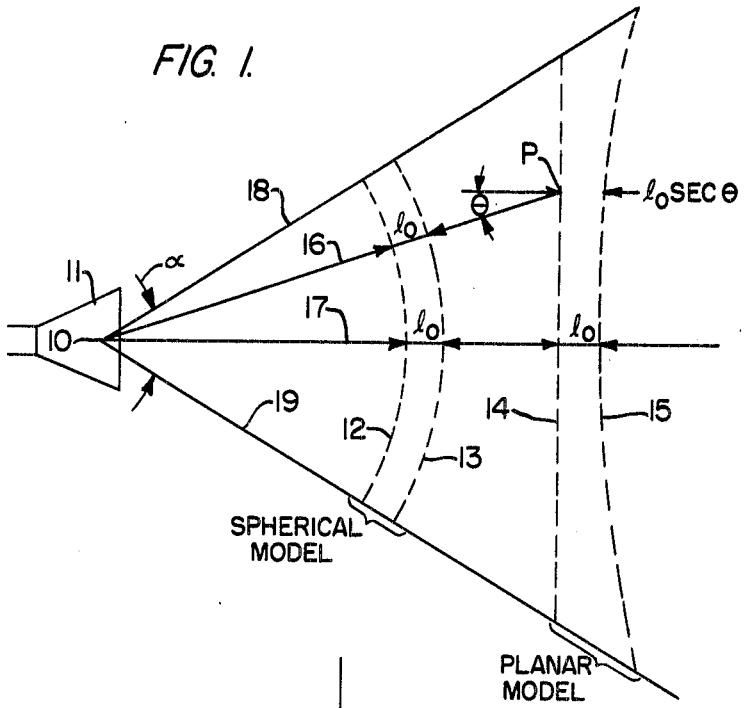
FIG. 1 is a diagrammatic, sectional view of respective spherical and planar multilayer antenna models having a constant cut-off frequency thereacross.

Referring to FIG. 1, there are shown sectional views of a multilayered spherically shaped dichroic structure and a planar shaped dichroic structure displaced relative to a suitable wave source. It will be presumed that each antenna structure is a transmitting antenna. The wave source may comprise a feed horn 11 having an emitting aperture $\alpha$ originating at focus 10, and bounded by radiation lines 18 and 19. The axis of horn 11 corresponds to radiation line 17 passing through focus 10.

The spherical model may comprise a pair of spherically-shaped artificial dielectric layers 12 and 13 each of which is centered at focus 10, the radius of layer 12 being less than the radius of layer 13 by the distance $1_o$ therebetween. Since each of layers 12 and 13 is spherical and concentric with the other, the separation or distance between layers 12 and 13 is a constant value $1_o$ for any radiation line, such as arbitrary line 16 within the horn aperture $\alpha$.

Each of the artificial dielectric dichroic layers 12 and 13 may be comprised of a plurality of conductive elements, such as metallic film elements, distributed on an insulating substrate, the individual elements being shaped and spaced apart from each other to provide a desired transmission versus frequency characteristic. Each artificial dielectric layer may be formed by plating a suitable substrate with a metal layer, such as copper, and then masking and etching the copper layer to leave a plurality of copper elements appropriately spaced apart from one another in accordance with a desired transmission characteristic. Of course, other types of artificial dielectrics may be used, such as selectively apertured conductive plates, as well known in the art. The patterns used for the respective artificial dielectrics are such that the size and spacing of the individual elements are non-resonant. Also, the separation or distance between the individual layers, such as the separation $1_o$ between layers 12 and 13 is less than one-half the wavelength of frequencies of interest. For a multilayered artificial dielectric antenna configuration comprised of a plurality of spherically shaped layers, such as layers 12 and 13, described above, and having a uniform sheet susceptance, there will be obtained an antenna having an insertion loss, phase shift characteristic that is constant or uniform for any point on the surface of the antenna. In the spherical model, a uniform sheet susceptance may be obtained by making each of the individual elements of which a layer is comprised of the same size and providing a uniform spacing between all elements. The insertion loss, phase shift characteristic may vary with frequency in the manner of the characteristic shown in FIG. 2, which illustrates the variation of insertion loss and phase with frequency for a multilayered artificial dielectric comprised of three spaced-apart artificial dielectric sheets.

Figure 2:
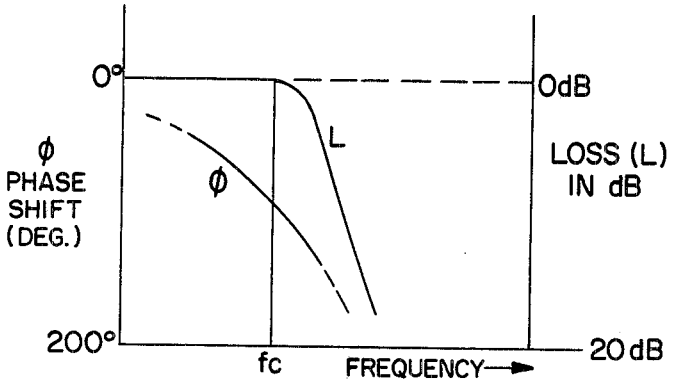
FIG. 2 is a response curve of a multilayer dichroic structure having a constant cut-off frequency.

As is shown in FIG. 2, the insertion loss is constant up to the cut-off frequency $f_c$ and increases rather abruptly above cut-off. Moreover, in the vicinity of the cut-off frequency $f_c$, the phase shift through the dichroic structure changes rapidly. In the spherically configured antenna model shown in FIG. 1, since the cut-off frequency $f_c$ is constant across the surface of the structure; namely, $f_c$ is constant irrespective of the point of incidence on the surface of the structure of a ray from focus 10, the amount of phase shift for any given frequency imparted to a radiated wave passing through the antenna will be the same regardless of where it impinges upon the dichroic surface. As a result, irrespective of frequency, all waves emitted by horn 11 and passing through layers 12 and 13 appear to have originated from focal point 10.

Using the basic spherically-shaped antenna model as a reference, it is possible to extrapolate the necessary parameters for dichroic structures of shapes other than spherical by a geometrical translation process. Thus, for the numerous antenna applications for which spherical surfaces are not used, one may appropriately translate the characteristics of the artificial dielectric of a spherical shape to the shape desired. As a simple example, FIG. 1 illustrates a planar antenna model comprised of a planar or flat layer 14 of artificial dielectric and an adjacent, spaced-apart layer 15, which together with layer 14, form a two-layered planar dichroic structure.

Planar layer 14 is perpendicular to radiation line 17, and along this horn axis, the separation between layers 14 and 15 is the same as the spacing between layers 12 and 13, along the axis, i.e. $1_o$. However, in a direction orthogonal to horn axis 17, since the wavefront varies inversely proportional to the cosine of the angle of incidence of a radiation line to the point of interest on layer 14, the separation between layer 15 and layer 14 at that point will correspondingly vary in proportion to the secant of the angle. Namely, as is shown in FIG. 1, an arbitrary radiation line 16 intersects surface 14 at point P at an angle $\theta$. The separation between spherical layers 12 and 13 along line 16 is $1_o$ (just as it is for all radiation lines). Therefore, layer 15 is displaced a distance $1_o \sec\theta$ from layer 14, in a direction parallel to axis 17. By using this translational relationship, the shape of layer 15 can be appropriately tapered from one end to the other. In addition, to maintain the sheet susceptance constant, the size and separation of the individual elements of which artificial dielectric 14 is comprised are multiplied by the same factor (i.e. $\sec\theta$) and these translated elements are then used to form artificial dielectric layer 15. With a planar model of a multilayered artificial dielectric configured in the manner described above, the response characteristic of the antenna will be uniform, just as for the spherical model. Namely, all waves emitted by horn 11 passing through layers 14 and 15 appear to have originated at focal point 10.

In accordance with the present invention, the insertion loss/phase shift characteristic of the antenna is caused to be assymetrical over the surface of the dichroic structure. Namely, for a transmitting antenna, the amount of phase shift that a wave emitted by the feed horn undergoes as it traverses the dichroic structure will vary depending upon its point of incidence on the dichroic structure. The result of this variation is an effective tilt of the phase front of an emitted wave, so that the apparent focal point of the wave will be variably offset from the focus of the antenna feed horn depending upon the frequency of the wave. This property of the dichroic structure produces numerous advantages over conventional antenna structures, among which is the ability of the structure to be used for selectively scanning waves of respectively different frequencies, simply by rotating the artificial dielectric surface.

Figure 3:
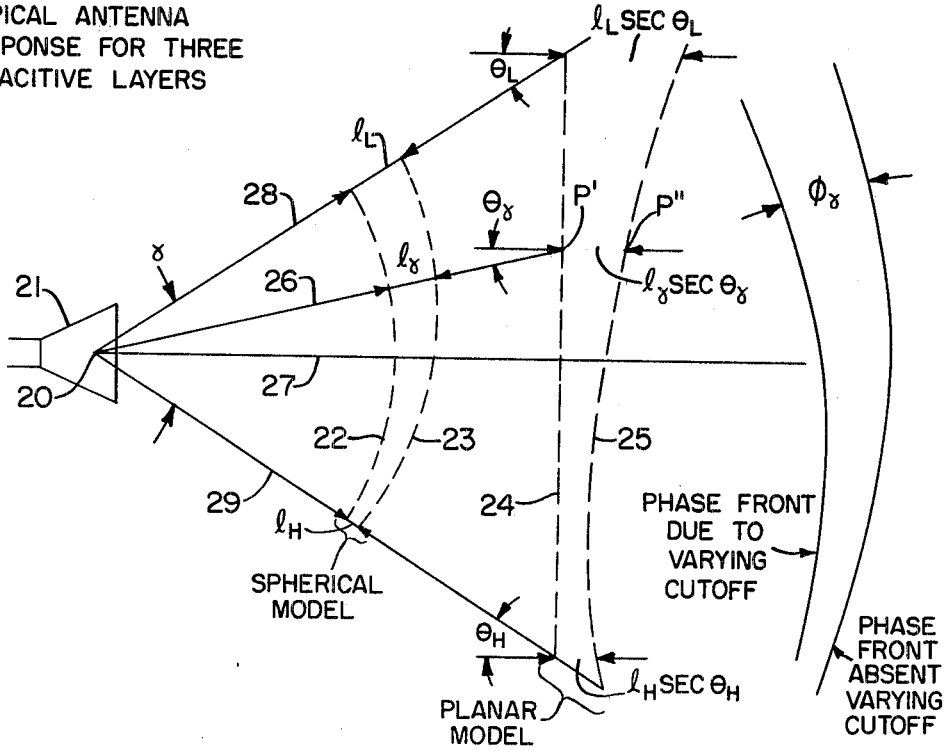
FIG. 3 is a diagrammatic sectional view of respective spherical and planar multilayer antenna models having a variable cut-off frequency thereacross.

FIG. 3 depicts the application of the present invention to the spherically-shaped and planar-shaped dichroic structures shown in FIG. 1. In the modified antenna configurations shown in FIG. 3, the cut-off frequency varies across the surface of the dichroic structure, thereby achieving a varying phase-shift characteristic over the surface of the antenna.

Considering first a modification of the spherical model shown in FIG. 1, a wave source, such as feed horn 21, having a transmitting aperture $\gamma$ originating at focus 20 and bounded by radiation lines 28 and 29, emits a spherical wavefront which may impinge upon a modified spherical model comprising a pair of artificial dielectric layers 22 and 23. Artificial dielectric layer 22 may contain a spherically-shaped dielectric layer having a center at focus 20, while artificial dielectric layer 23 may also be curved (e.g. spherical) but unevenly spaced apart from layer 22, so that the distance between layers 22 and 23 varies across their surfaces. Namely, the focal point of radial lines for layer 22 may be the focal point 20 of the wavefront emitted by feed horn 21; however, layer 23 may also be spherically shaped but may have its center offset relative to point 20, so that the spacing between layer 22 and layer 23 is not constant for any point on their surfaces. In the sectional view shown in FIG. 3, the spacing 1 may vary from a minimum separation $1_H$ to a maximum separation $1_L$.

Figure 4:
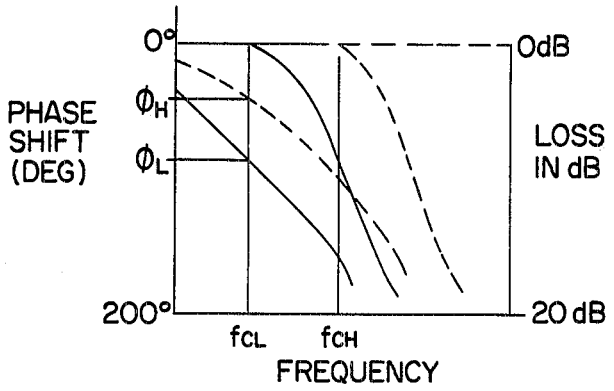
FIGS. 4, 8, and 9 are response curves of a multilayer dichroic structure having a variable cut-off frequency.

FIG. 4 illustrates the transmission and phase shift versus frequency characteristics of an dichroic structure, such as those shown in FIG. 3, having a tapered separation between layers, with a cut-off frequency which varies from a low cut-off frequency ($f_{cL}$) where the layer separation 1 is maximum ($1_L$) to a high cut-off frequency ($f_{cH}$) where the layer separation 1 is a minimum ($1_H$). As can be seen from FIG. 4, there is an overall phase delay ($\phi_L - \phi_H$) from one end of the dichroic structure to the other. This phase delay effectively tilts or offsets the wavefront emitted from the antenna surface, so that a transmitted wavefront may appear to have originated from a point displaced relative to the focus 20 of feed horn 21. The amount of offset or displacement will depend upon the frequency of the wave, as shown in FIG. 4.

Implementation of a spherically shaped dichroic structure having a cut-off frequency which varies across the surface of the structure may be effected by varying either the sheet susceptance, spacing between the layers, or both. Assuming that the sheet susceptance is held constant, a variation in the separation between layer 22 and layer 23 from one side to the other, such as the separation from minimum spacing $\mathbf{1}_H$ to maximum separation $\mathbf{1}_L$, shown in FIG. 3, is sufficient to create an assymetrical or tapered cut-off frequency characteristic across the dichroic structure and thereby obtain a tilted phase front as shown in the right hand portion of FIG. 3.

FIG. 3 also shows a planar dichroic structure, similar to the planar model shown in FIG. 1, but modified on the basis of the modified spherical model shown in FIG. 3, to achieve a non-constant cut-off frequency across the dichroic structure, as opposed to the constant-cut-off planar model shown in FIG. 1. In other words, having established the configuration of the asymetrical spherical model, one can again proceed to implement tapered dichroic surface shapes other than spherical by the use of appropriate transformation relationships. In the example of the modified planar model shown in FIG. 3, the basic transformation relationship again involves the inverse of the cosine (i.e. the secant) of the angle between a radial line from the focus of the feed horn to the point of interest on the dichroic surface.

More specifically, in FIG. 3, radiation line 27 represents the axis of feed horn 21, and passes through its focus 20. Using the modified spherical model as a reference, with a tapered spacing between layers 22 and 23, the proper tapering of layer 25, relative to planar layer 24, can be obtained by offsetting the taper of layer 25 relative to layer 24 in accordance with the product of the offset spacing between layers 22 and 23 along a radiation line that intersects the point of interest on layer 24 and the secant of the angle that the radiation line makes with the layer of interest (layer 24 here) at that point.

Thus, looking at an arbitrary radiation line 26, extending from focus 20 of feed horn 21 to some point P' on layer 24, the separation of layer 25 from layer 24 along a line perpendicular to layer 24 at that point P' (the distance from point P' on layer 24 to point P'' on layer 25) is determined by measuring the separation $\mathbf{1}_\gamma$ along line 26 between layers 22 and 23, and by measuring the angle $\theta_\gamma$ that line 26 makes with layer 24 at point P'. The separation between points P' and P'' on layers 24 and 25 is then set as the product of the separation $\mathbf{1}_\gamma$ and the secant of the measured angle $\theta_\gamma$, or $\mathbf{1}_\gamma \sec \theta_\gamma$. Thus, along aperture boundary lines 28 and 29, the required spacings are $\mathbf{1}_L \sec \theta_L$ and $\mathbf{1}_H \sec \theta_H$, respectively.

Figure 5:
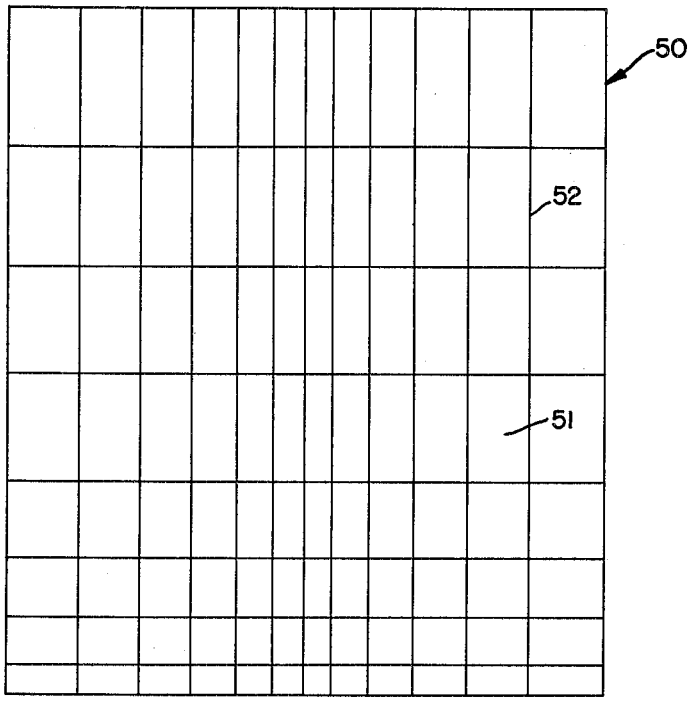
FIG. 5 is a plan view of a dichroic, artificial, dielectric sheet.

FIG. 5 illustrates a plan view of a planar sheet of artificial dielectric, the elemental pattern of which varies the size and shape of individual elements across the surface of the dielectric. As described previously, a suitable artificial dielectric layer may comprise a pattern of metal elements, such as an etched copper film plated on the surface of an insulating substrate. In FIG. 5, the dielectric sheet 50 is comprised of a plurality of metallic (e.g. copper) rectangles 51 distributed over the surface of a substrate 52, which is exposed along the separations between the elements 51. An antenna feed horn may be disposed with its focus at one end of a multilayer structure made up of a plurality of such sheets 50 so that the antenna feed horn may direct emitted radiation at a prescribed angle toward the antenna surface. As is shown in FIG. 5, the size of the elements 51 and the spacings 52 between the individual elements 51 increase from the lower end of the sheet, where the feed horn may be situated, to the upper end. Also, the dimensions of the elements and the spacings between the elements increase laterally across the sheet. This size variation effectively causes the feed horn to see the same sized element regardless of angles, thereby achieving a constant sheet susceptance across the antenna.

Figure 6:
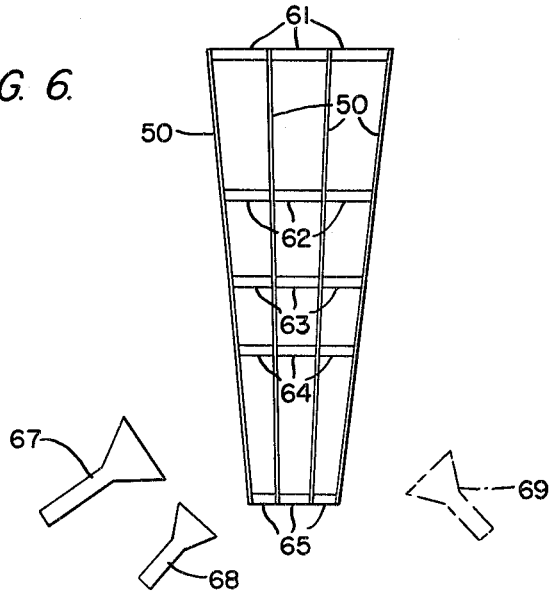
FIG. 6 is a diagrammatic illustration of a multiple-feed antenna system having a multilayer dichroic structure.

A side view of a multilayered artificial dielectric dichroic antenna employing a plurality of artificial dielectric sheets 50 as shown in FIG. 5 is illustrated in FIG. 6. Here, a plurality of artificial dielectric sheets 50 are separated by insulator spacers 61 through 65 of successively smaller size to create a tapered artificial dielectric antenna configuration. With the size and spacings of the individual elements 51 of each sheet 50 adjusted to provide a constant sheet susceptance across each sheet, as explained previously, the tapering of the multilayered dichroic structure from the lower end to the upper end, as shown in FIG. 6, will effectively vary the cut-off frequency from the lower end to the upper end of the antenna, and thereby subject transmitted frequencies to a possible phase tilt (depending upon the frequency). A pair of feed horns, such as horns 67 and 68, may be disposed adjacent one another on one side of the tapered dichroic structure to selectively transmit separate frequencies via the multilayered dichroic configuration, taking advantage of its varying cut-off characteristic. In this latter case, the frequencies transmitted by horns 67 and 68 may be so related to the variable cut off characteristic of the dichroic structure, that one horn, such as horn 67, transmits its energy through the structure with only a slight amount of phaseshift, while the output of horn 68 is subjected to a significant amount of phase-shift across the dichroic structure.

Figure 8:
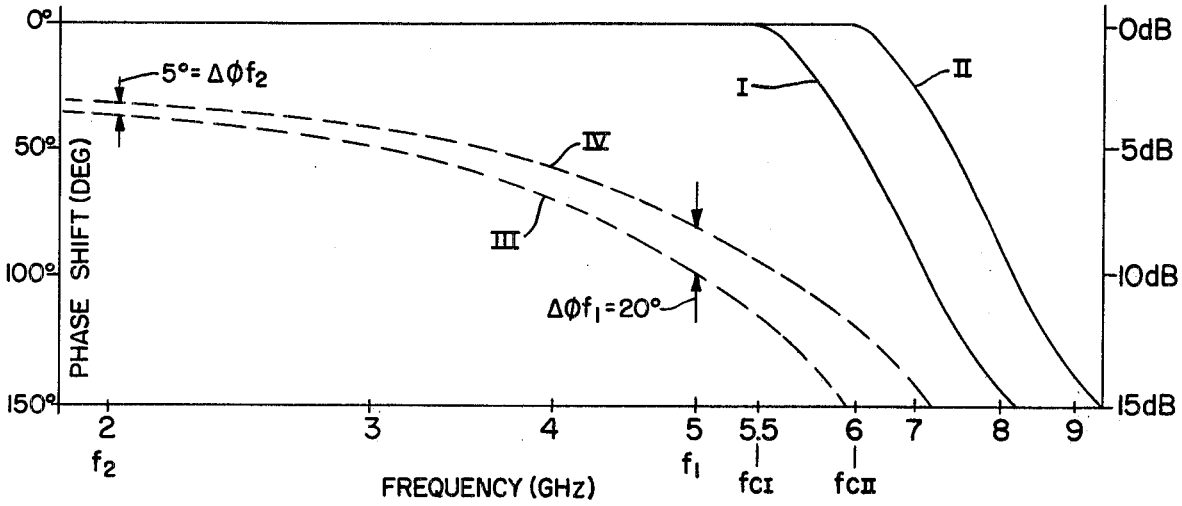

More specifically, and referring to FIG. 8, the transmission response characteristic of a three layer artificial dielectric structure in accordance with the present invention is shown. Curves I and II represent the insertion loss at opposite ends of the tapered surface at which the surface has respective cut off frequencies $f_{cI}=5.5$ GHz and $f_{cII}=6$ GHz. As is shown in FIG. 8, for frequencies well below the vicinity of the lower cut-off frequency $f_{cI}$, a wave will be effectively transmitted with very little phaseshift. However, in the vicinity of the varying cut-off range of the dichroic structure, there is a varying degree of insertion loss accompanied by a substantial amount of phaseshift from the lower end of the dichroic structure surface to the upper end. Therefore, if horn 68 is supplied with a frequency $f_1$ at 5 GHz it will be effectively transmitted through the structure with a substantial phaseshift $\Delta\phi f_1=20°$ across the antenna, thereby tilting the antenna pattern off axis. A frequency $f_2=2$ GHz supplied to horn 67 will be transmitted through the antenna without appreciable phase tilt ($\Delta\phi f_2=5°$), and proper orientation of horns 67 and 68 relative to the antenna permits both frequencies $f_1=5$ GHz and $f_2=2$ GHz to be transmitted by the antenna and also with one frequency being transmitted in a direction off-set relative to the axis of the other frequency. Thus, waves passing through the dichroic structure may appear to be originating from the same point.

Figure 7:
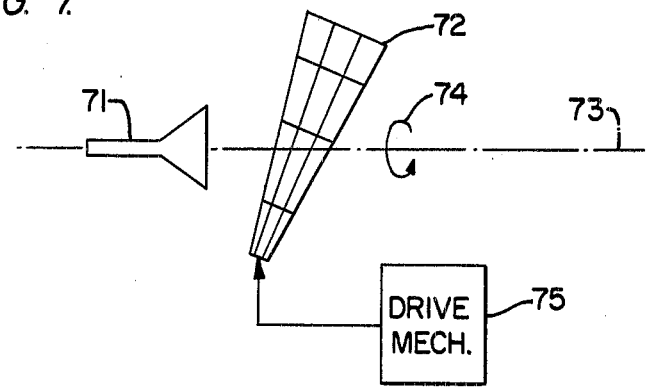
FIG 7 is a diagrammatic illustration of a scanning arrangement for a multilayer dichroic structure.

FIG. 7 is a diagrammatic illustration of a simple rotating scanning arrangement which may be adopted for one or more frequencies, a single feed horn 71 being illustrated in the Figure to simplify the drawing. Multilayered dichroic structure 72 is suitably coupled to a drive mechanism 75 for rotating structure 72 about feed horn axis 73 in the direction of arrow 74. Referring again to FIG. 8, let it be assumed that the transmission and phase response characteristic for multilayered dichroic structure 72 varies in accordance with curves I through IV, and that horn 71 is operating at frequency $f_1=5$ GHz. Because the frequency of the output of horn 71 is in the vicinity of the cut-off region of structure 72, there is a substantial phase change $\Delta\phi f_1=20°$ across the dichroic structure, so that the far field antenna pattern is tilted off the horn axis 73. Rotation of structure 72 by drive mechanism 75 causes this far field pattern to be scanned about axis 73.

Figure 9:
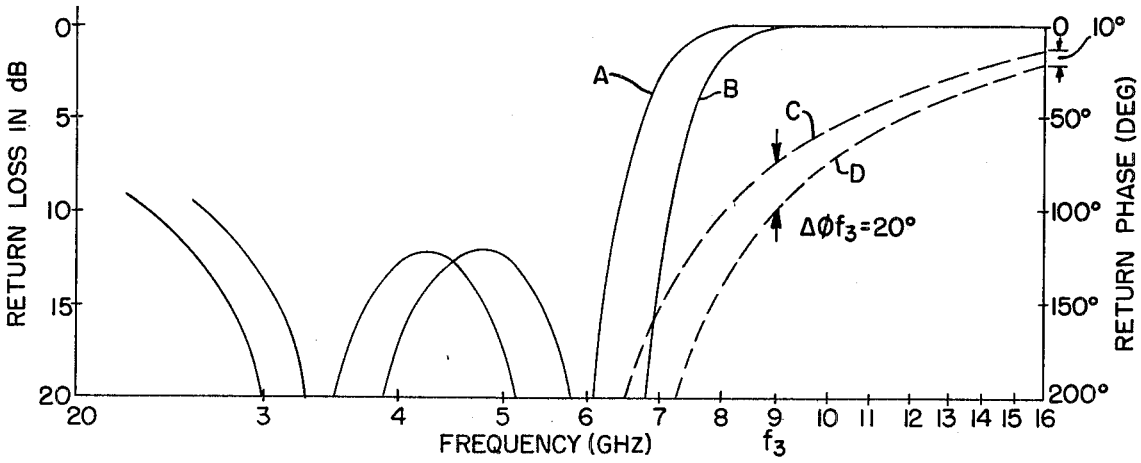

The dichroic antenna arrangement of the present invention may also be used in the reflective mode. FIG. 9 shows a reflection response curve for an exemplary four layer dichroic structure, similar to the tapered dichroic structure illustrated in FIG. 6. The cut-off frequency varies from 8 GHz to 9 GHz yielding a 20° phaseshift for a horn operating at $f_3=9$ GHz. At 16 GHz the phaseshift across the structure is only about 10°, thus providing a variable phaseshift with frequency opposite that described above for the transmission mode. Using these dual characteristics, a combination reflection mode-transmission mode system may be employed using only a single variable cut off dichroic structure in accordance with the present invention. Referring again to FIG. 6, there is shown an additional feed horn 69 located on the side of the antenna opposite horn 68. Assuming that respective frequencies are applied to horns 68 and 69, the frequency output of horn 68 may be below the cut-off frequency range, while that provided by horn 69 may be above cut-off so that the output of horn 68 is transmitted and the output of horn 69 is reflected. Depending upon the phase shift across the dichroic structure for the frequencies provided by horns 68 and 69, either or both of the outputs may be tilted, as along separate axial directions, to thereby permit both horn outputs to be scanned simultaneously by rotating antenna 50 about a selected axis. Further, multiple feed arrangements other than those described and illustrated above may be implemented to permit selective scanning of a plurality of desired frequencies relative to each other.

The foregoing description of the invention has proceeded on the assumption that the sheet susceptance of the dichroic layers of the dichroic structure is held constant and variation of the cut off frequency is achieved by a differential separation of the layers from one end of the structure to the other. However, the sheet susceptance can be varied as by appropriately adjusting the size and spacing of the individual elements of which a dichroic layer is comprised. Also, both the sheet separation and susceptance can be varied to change the cut-off across the structure. Moreover, the artificial dielectric of which the dichroic layers are composed may be made from capacitive, inductive, or a combination of capacitive and inductive elements.

As will be appreciated from the foregoing description of the present invention, by varying the cut-off frequency across an artificial dielectric dichroic surface, it is possible to selectively control the degree of phase shift imparted to transmitted and/or reflected frequencies, thereby permitting relative scanning of plural frequencies by rotation of the structure relative to a selected axis. This affords a greater flexibility in conscan feed design, and improved mechanical configurations over conventional lens approaches.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. An antenna system comprising:

a dichroic antenna structure the cut-off frequency of which varies across its surface, said dichroic structure having the property such that the degree of phase shift imparted by said structure to incident frequency signals in the vicinity of cut-off varies in dependence upon frequency;

first means for directing at least one signal, the frequency of which is in the vicinity of the cut-off frequency of the dichroic antenna structure, at said dichroic antenna structure; and second means for moving said dichroic antenna structure relative to at least said one directed signal.

2. An antenna system according to claim 1, wherein said structure comprises a plurality of layers of artificial dielectric material the spacing between which varies across the antenna structure.

3. An antenna system according to claim 1, wherein said antenna structure comprises a plurality of layers of artificial dielectric material the sheet susceptance of which varies across the antenna structure.

4. An antenna system according to claim 3, wherein the spacing between said layers of artificial dielectric material varies across the antenna structure.

5. An antenna system according to claim 2, wherein the sheet susceptance of the layers of artificial dielectric material is constant across the antenna structure.

6. An antenna system according to claim 1, wherein said first means comprises means for directing a plurality of signals, the frequency of which is in the vicinity of the cut off frequency of said dichroic antenna structure, at said dichroic antenna structure.

7. An antenna system according to claim 1, wherein said first means comprises means for directing a signal the frequency of which is remote from the vicinity of the cut off frequency of said dichroic antenna structure, at said dichroic antenna structure.

8. An antenna system according to claim 7, wherein the frequency remote from the vicinity of the cut off frequency is lower than the cut off frequency.

9. An antenna system according to claim 7, wherein the frequency remote from the vicinity of the cut off frequency is greater than the cut off frequency.

10. An antenna system according to claim 6, wherein said antenna comprises a plurality of layers of artificial dielectric material the spacing between which varies across the antenna structure.

11. An antenna system according to claim 6, wherein said antenna structure comprises a plurality of layers of artificial dielectric material the sheet susceptance of which varies across the antenna structure.

12. An antenna system according to claim 11, wherein the spacing between said layers of artificial dielectric material varies across the antenna structure.

13. An antenna system according to claim 10, wherein the sheet susceptance of the layers of artificial dielectric material is constant across the antenna structure.

14. An antenna system according to claim 1, wherein said first means comprises means for directing a plurality of respectively different frequency signals at said dichroic antenna structure such that said different frequency signals appear to have originated from the same point.

15. A method of scanning at least one frequency signal over a prescribed space comprising the steps of:

directing said at least one frequency signal at a dichroic antenna structure the cut-off frequency of which varies across its surface, said dichroic antenna structure having the property such that the degree of phase shift imparted by said structure to incident frequency signals in the vicinity of cut-off varies in dependence upon frequency; and moving said surface.

16. A method according to claim 15, wherein said antenna structure comprises a plurality of layers of artificial dielectric material the spacing between which varies across the antenna structure.

17. A method according to claim 15, wherein said antenna structure comprises a plurality of layers of artificial dielectric material the sheet susceptance of which varies across the antenna structure.

18. A method according to claim 17, wherein the spacing between said layers of artificial dielectric material varies across the antenna structure.

19. A method according to claim 16, wherein the sheet susceptance of the layers of artificial dielectric material is constant across the antenna structure.

20. A method according to claim 15, wherein said directing step includes the step of directing a plurality of frequency signals at said antenna structure.

21. A method according to claim 20, wherein one of said frequency signals has a frequency in the vicinity of the cut off frequency.

22. A method according to claim 20, wherein more than one of said plurality of frequency signals has a frequency in the vicinity of the cut off frequency.

23. A method according to claim 21, wherein one of said frequency signals has a frequency remote from the vicinity of the cut off frequency.

24. A method according to claim 23, wherein the frequency remote from the vicinity of the cut off frequency is lower than the cut off frequency.

25. A method according to claim 23, wherein the frequency remote from the vicinity of the cut off frequency is greater than the cut off frequency.

26. A method according to claim 16, wherein said directing step includes the step of directing a plurality of frequency signals at said antenna structure.

27. A method according to claim 26, wherein one of said frequency signals has a frequency in the vicinity of the cut off frequency.

28. A method according to claim 27, wherein one of said frequency signals has a frequency remote from the vicinity of the cut off frequency.

29. A method according to claim 20, wherein said directing step comprises directing a plurality of respectively-different frequency signals at said dichroic antenna structure such that said different frequency signals appear to have originated from the same point.

* * * * *